US007503475B2

(12) United States Patent
McGowan

(10) Patent No.: US 7,503,475 B2
(45) Date of Patent: Mar. 17, 2009

(54) CARTON WITH SLIDABLE TAB FOR CONTROLLING DISPENSING

(75) Inventor: Gregory H. McGowan, Henniker, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 531 days.

(21) Appl. No.: 11/127,639

(22) Filed: May 12, 2005

(65) Prior Publication Data

US 2006/0255113 A1 Nov. 16, 2006

(51) Int. Cl.
*B65D 17/00* (2006.01)

(52) U.S. Cl. ..... 229/220; 222/476; 229/125.12

(58) Field of Classification Search ..... 229/125.08, 229/125.12, 210, 220, 129.1, 125, 125.125; 206/468; 220/345.1, 345.2, 345.3; 222/476, 222/477

See application file for complete search history.

(56) References Cited

U.S. PATENT DOCUMENTS 1,951,274 A * 3/1934 Denman ..... 229/131.1
2,975,952 A * 3/1961 Tamarin ..... 229/220
4,094,456 A 6/1978 Raccaforte
4,138,016 A 2/1979 Roccaforte
4,141,485 A 2/1979 Lambert
4,197,985 A * 4/1980 Austin ..... 229/220
4,201,329 A 5/1980 Roccaforte
4,361,270 A 11/1982 Roccaforte
4,609,142 A 9/1986 Adamek
5,056,708 A 10/1991 Boyle et al.

FOREIGN PATENT DOCUMENTS

CH 412 695 A 4/1966
GB 385033 A 12/1932

* cited by examiner

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

An upper end of a carton includes first and second panels that are in an overlapping relationship with respect to one another. The first panel includes an opening for being in communication with the carton's interior. A flexible, elongate closure tab extends through a slot so that the closure tab is interposed between the first and second panels. The closure tab can be slid between the first and second panels, between open and closed configurations. In the closed configuration, the closure tab at least substantially obstructs the opening. In the open configuration, the opening is not substantially obstructed by the closure tab. A projection is engaged by the closure tab for discouraging the closure tab from being completely pulled out of the slot during the open configuration.

32 Claims, 5 Drawing Sheets

CARTON WITH SLIDABLE TAB FOR CONTROLLING DISPENSING

BACKGROUND OF THE INVENTION

The present invention generally relates to containers with sliding tabs for controlling dispensing.

It is known for a carton to have a tab that can be slid between portions of the carton and relative to an opening, for opening and closing the opening and thereby controlling dispensing from the carton. For example, U.S. Pat. No. 4,094,456 discloses such a carton. A problem that can be encountered with such a carton is that the tab can be slid too far outwardly, such that the tab has to be reinserted.

For the foregoing other reasons, there is a desire for improvements.

BRIEF SUMMARY OF SOME ASPECTS OF THE INVENTION

In accordance with one aspect of the present invention, a reclosable carton for dispensing includes upper and lower ends, with a sidewall extending between the upper and lower ends and at least partially around the carton's interior. The upper end includes first and second panels that are in an overlapping relationship with respect to one another, and at least the first panel includes an opening for being in communication with the carton's interior. A flexible, elongate closure tab is connected to the sidewall and extends through a slot so that a portion of the closure tab is interposed between the upper end's first and second panels. The portion of the closure tab can be slid between the first and second panels to provide closed and opened configurations. In the closed configuration, the portion of the closure tab at least substantially obstructs the opening in the top end. The opening in the top end is not substantially obstructed by the closure tab during the open configuration. In accordance with one aspect of the present invention, restricting means is provided for at least discouraging the closure tab from being completely pulled out of the slot.

In accordance with one aspect of the present invention, the restricting means includes a projection that projects from the sidewall. The projection is for being engaged to a predetermined feature of the closure tab and thereby at least discouraging the closure tab from being completely pulled out of the slot. The predetermined feature of the closure tab can be an edge of the closure tab. The edge of the closure tab can at least partially define an opening in the closure tab, with the projection extending into the opening during the open configuration. The projection can be a restricting tab. The sidewall can include inner and outer panels that are in an overlapping relationship with respect to one another. The closure tab can be an extension of the outer panel, and the restricting tab can be an extension of the inner panel.

In accordance with one aspect of the present invention, the restricting means can advantageously allow the upper end's opening to be positioned in relatively close proximity to the front of the carton.

Other aspects and advantages of the present invention will become apparent from the following.

BRIEF DESCRIPTION OF THE DRAWINGS

Having described some aspects of the invention in general terms, reference will now be made to the accompanying drawings, which are illustrative of an exemplary embodiment of the present invention and are not necessarily drawn to scale, and wherein.

DETAILED DESCRIPTION OF EMBODIMENTS OF THE INVENTION

Figure 1:
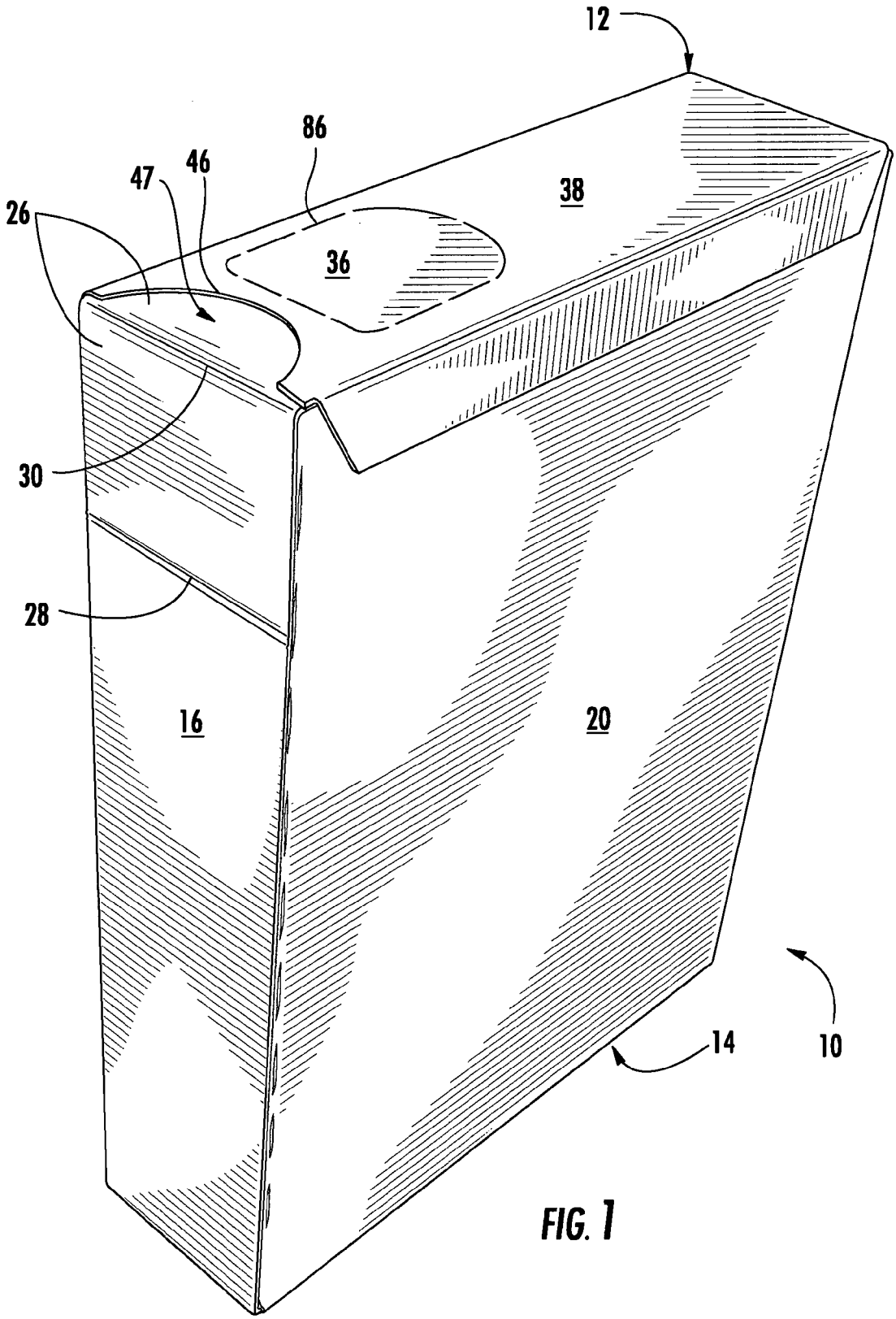
FIG. 1 is a pictorial view of a carton with its slidable closure tab in a closed configuration, and a security tab installed.

Referring now in greater detail to the drawings, in which like numerals refer to like parts throughout the several views, a reclosable carton designated by the numeral 10 will be described in the following, in accordance with an exemplary embodiment of the present invention. As best understood with reference to FIG. 1, the carton 10 includes top and bottom ends 12, 14 that are spaced apart from one another in a longitudinal direction. A sidewall extends longitudinally between the top and bottom ends 12, 14. As can be generally understood primarily with reference to FIG. 4, the sidewall can be in the form of an outer front panel 16, inner front panel 18, right side panel 20, left side panel 22 and rear panel 24 (FIG. 5) that are respectively connected to one another so that they collectively extend around the carton's interior. The outer front panel 16 overlaps and is fastened to a lower portion of the inner front panel 18. The front panels 16, 18 are at the front of the carton 10, whereas the rear panel 24 is at the rear of the carton, and the front and rear of the carton can be characterized as being spaced apart in a lateral direction.

Figure 3:
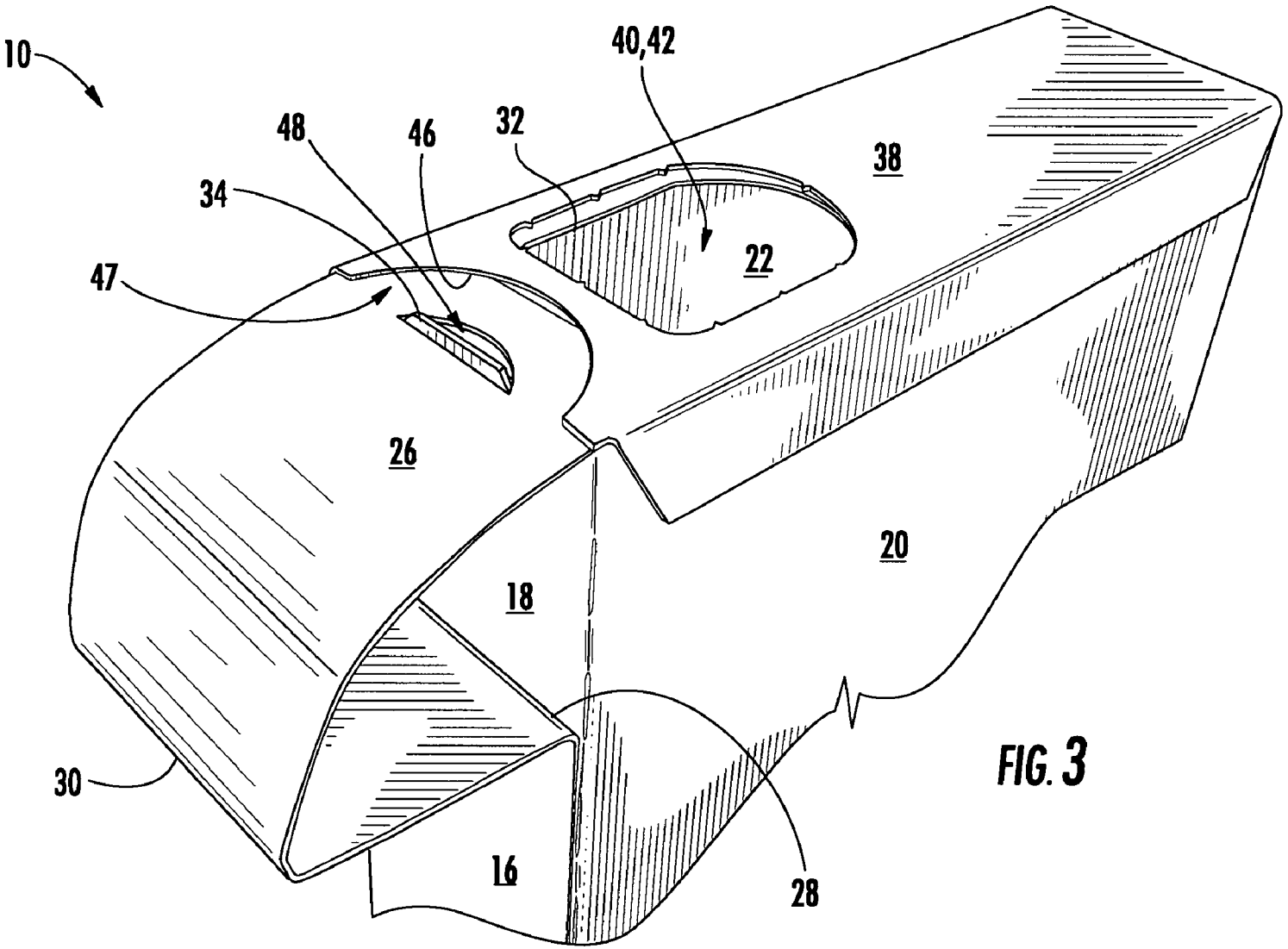
FIG. 3 is a pictorial view of a portion of the carton with the slidable closure tab in an opened, releasably locked configuration.
Figure 4:
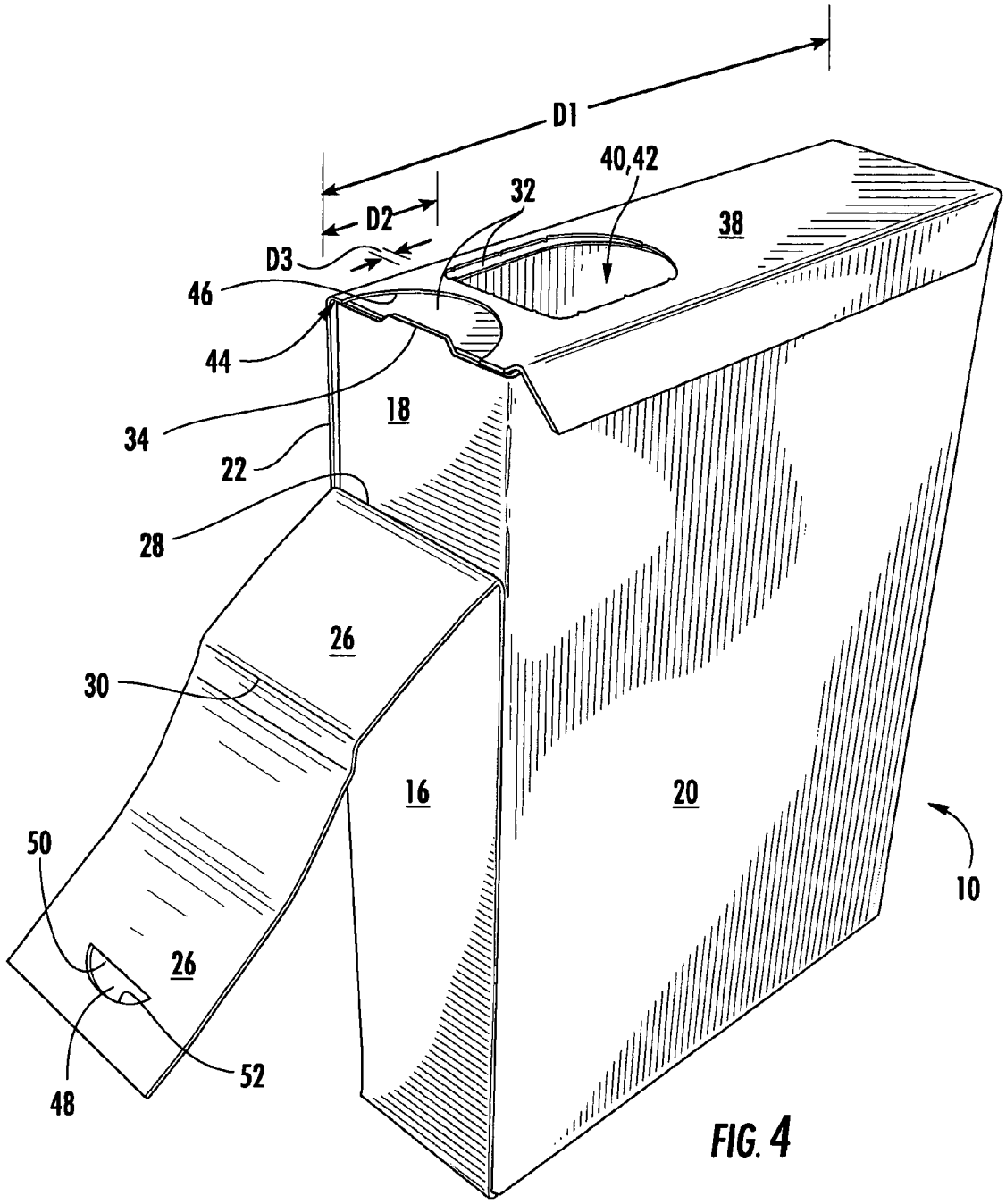
FIG. 4 is a pictorial view of a portion of the carton with the slidable closure tab in an opened, uninserted configuration.

A slidable closure tab 26 is connected to the outer front panel 16 at an intermediate lateral fold line 28. In addition, an upper lateral fold line 30 can extend across the closure tab 26 so that the closure tab can readily conform to the edge of the carton 10 that is illustrated in FIG. 4 as being defined by adjacent edges of the inner front panel 18 and an inner upper panel 32. As also illustrated in FIG. 4, a projection, which can more specifically be referred to as a restricting tab 34, protrudes upwardly from the inner front panel 18 for advantageously interacting with the closure tab 26, as will be discussed in greater detail below with reference to FIG. 3. Advantageously, the restricting tab 34 is not so large that it unduly interferes with operation of the closure tab 26 while the closure tab is in, or proximate, the closed configuration illustrated in FIG. 1.

Figure 2:
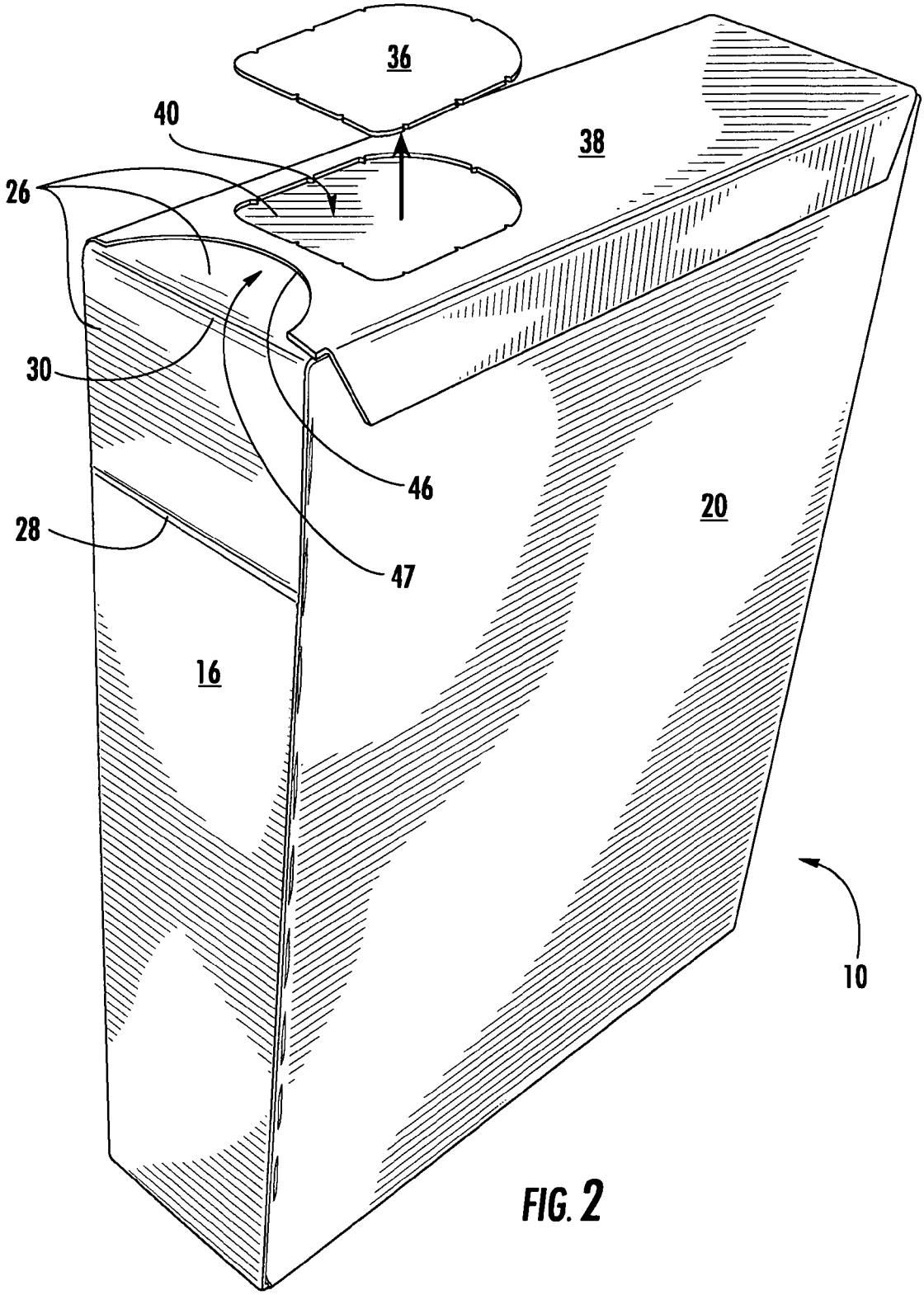
FIG. 2 is like FIG. 1, except that the security tab is exploded away from the carton.

FIG. 1 illustrates the carton 10 in the closed configuration with a security tab 36 installed. FIG. 2 is like FIG. 1, except that in FIG. 2 the security tab 36 has been removed from the carton 10 and is shown exploded away from the carton. The security tab 36 is a removable part of an outer upper panel 38 that overlaps the inner upper panel 32. Typically, the security tab 36 will be discarded after being removed from the carton 10 by an end-user of the carton (i.e., a user that dispenses goods from within the carton while the carton is in the open configuration). Removal of the security tab 36 exposes an opening in the outer upper panel 38, and this opening in the outer upper panel can be referred to as the outer opening 40.

The end of the closure tab 26 that is distant from the outer front panel 16 can be characterized as the slidable end of the closure tab, because the slidable end is for sliding between the inner and outer upper panels 32, 38. The slidable end of the closure tab 26 is positioned between the upper panels 32, 38 and obstructs the outer opening 40 while the carton is in the closed configuration. At the same time, the slidable end of the closure tab 26 obstructs an opening in the inner upper panel 32. This obstructed opening in the inner upper panel 32 can be referred to as the inner opening 42. The inner opening 42 is in communication with the interior of the carton 10. In addition, the inner opening 42 is aligned with the outer opening 40, so that the inner and outer openings 40, 42 are open to one another while the slidable end of the closure tab 26 is not interposed between them and is thereby in the open configuration. For example, FIG. 3 illustrates the closure tab 26 in an opened, releasably locked configuration, whereas FIG. 4 illustrates the closure tab 26 in an opened, uninserted configuration.

Reiterating, the slidable end of the closure tab 26 can be slid in the space between the upper panels 32, 38 to transition the carton 10 between the closed and opened configurations. If the closure tab 26 becomes positioned in the uninserted configuration illustrated in FIG. 4, a user can insert the slidable end of the closure tab into the space between the inner and outer upper panels 32, 38 by passing the slidable end of the closure tab 26 through a slot. A portion of this slot is generally designated by the numeral 44 in FIG. 4. The slot 44 is defined between the forward end edges of the inner and outer upper panels 32, 38.

At an intermediate position along the forward edge of the outer upper panel 38, an arcuate cut edge 46 extends rearward into the outer upper panel. The cut edge 46 can be characterized as defining an access opening 47 in the outer upper panel 38. The access opening 47 is located at, and open at, the forward end of the outer upper panel. The access opening 47 is for allowing a user to access a portion of the closure tab 26 during the closed configuration, so that the closure tab can be readily transitioned to the opened configuration. More specifically, with the slidable end of the closure tab 26 in the closed configuration illustrated in FIGS. 1 and 2, the user can place a thumb or finger, or the like, upon the portion of the closure tab 26 that is exposed by way of the cut edge 46/access opening 47. The user can use their thumb or finger, or the like, to draw a portion of the closure tab 26 out of the slot 44.

Then, the user can grasp the portion of the closure tab 26 that extends outwardly of the slot 44, and slidingly reciprocate the slidable end of the closure tab 26 within the space between the upper panels 32, 38 to transition the carton 10 between the closed and opened configurations. In the open configurations illustrated in FIGS. 3 and 4, the inner and outer openings 40, 42 are not obstructed by the closure tab 26 so that goods, such as food, detergent or any other suitable goods, can be dispensed from the carton 10 via the unobstructed inner and outer openings 40, 42. In the closed configuration illustrated in FIG. 2, the inner and outer openings 40, 42 are obstructed by the closure tab 26 so that the goods are not dispensed from the carton 10 via the inner and outer openings 40, 42.

Advantageously, while the carton 10 is in the open configuration, and before the slidable end of the closure tab 26 is pulled all the way out of the slot 44, the restricting tab 34 can engage a predetermined feature of the closure tab 26. In accordance with the exemplary embodiment of the present invention, the predetermined feature of the closure tab 26 is an arresting opening 48 that is defined in the slidable end of the closure tab 26; and more specifically, the predetermined feature of the closure tab 26 is an arcuately curved arresting edge 52 that partially defines the arresting opening 48. The arresting opening 48 is further defined by a straight edge 50 that extends between ends of the arresting edge 52. A variety of differently shaped arresting openings 48 are within the scope of the present invention.

The engagement between the restricting tab 34 and the closure tab's arresting edge 52 can at least discourage the closure tab 26 from being pulled all the way out of the slot 44. This can advantageously help to avoid the need to reinsert the closure tab 26 into the slot 44. Because the restricting tab 34 is provided for discouraging the closure tab 26 from being pulled all the way out of the slot 44, a relatively small distance can be provided between the openings 40, 42 and one or both of the front of the carton 10 and the rearward portion of the cut edge 46/access opening 47. By avoiding the inclusion of a relatively large distance between the openings 40, 42 and the front of the carton 10, and/or a relatively large distance between the inner and outer openings 40, 42 and the rearward portion of the cut edge 46/access opening 47, the outer and inner openings 40, 42 can be in relatively close proximity to the front of the carton. Such close proximity can advantageously help to facilitate pouring goods out of the carton 10 via the outer and inner openings 40, 42.

Figure 5:
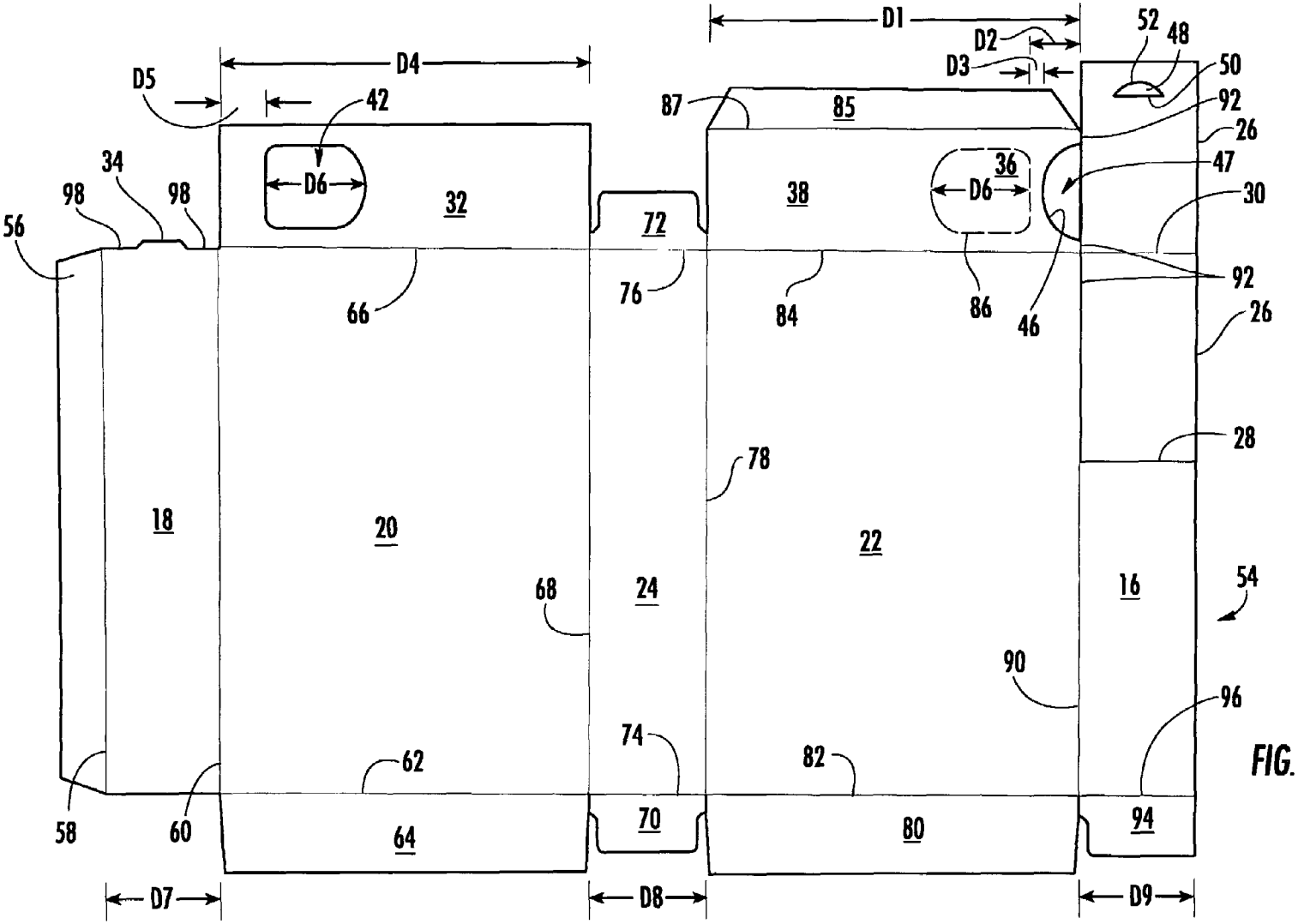
FIG. 5 is a plan view of a blank from which the carton can be erected.

A minimum distance between the front and rear of the carton 10 is at least generally designated by the dimension D1 in FIGS. 4 and 5. Similarly, a minimum distance between the forward end of the inner and outer openings 40, 42 and the front of the carton 10 is at least generally designated by the dimension D2, and minimum distance between the forward end of the inner and outer openings 40, 42 and the rearward end of the outer upper panel's cut edge 46/access opening 47 is designated by the dimension D3. As mentioned above, it can be advantageous for the dimensions D2 and D3 to be relatively small as compared to the dimension D1. Nonetheless, and in accordance with alternative embodiments of the present invention, the dimensions D2 and D3 are not relatively small as compared to the dimension D1, meaning that the present invention is not intended to be limited to the specific relative sizes disclosed in the following.

In accordance with the exemplary embodiment of the present invention, the minimum distance between the forward end of the inner and outer openings 40, 42 and the front of the carton 10, which is at least generally designated by the dimension D2, is less than about 19% of the minimum distance between the front and rear of the carton 10, which is at least generally designated by the dimension D1. More specifically, the dimension D2 is less than about 17% of the dimension D1. Even more specifically, the dimension D2 is less than about 15% of the dimension D1. Still even further specifically, the dimension D2 is less than, or equal to, about 13.3% of the dimension D1.

In accordance with the exemplary embodiment of the present invention, the minimum distance between the forward end of the inner and outer openings 40, 42 and the rearward end of the outer upper panel's cut edge 46/access opening 47, which is designated by the dimension D3, is less than about 9% of the minimum distance between the front and rear of the carton 10, which is at least generally designated by the dimension D1. More specifically, the dimension D3 is less than about 7% of the dimension D1. Even more specifically, the dimension D3 is less than about 5% of the dimension D1. Still even further specifically, the dimension D3 is less than, or equal to, about 3.3% of the dimension D1.

While the closure tab 26 is in the opened, releasably locked configuration illustrated in FIG. 3, it can be returned its closed configuration illustrated in FIGS. 1 and 2 by manually feeding the closure tab 26 through the slot 44 until the closed configuration illustrated in FIGS. 1 and 2 is achieved. In accordance with the exemplary embodiment of the present invention, while the restricting tab 34 is in the arresting opening 48 and the closure tab 26 begins to be fed through the slot 44, the restricting tab 34 pivots toward the arcuate cut edge 46 of outer upper panel 38 so that the straight edge 50 of the closure tab 26 slides across and then off of the restricting tab. The closure tab 26 continues to slide on the restricting tab 34 while the closure tab continues to be fed into the slot 44. The restricting tab 34 can, but is not required to, remain at least somewhat pivoted toward the arcuate cut edge 46 of the outer upper panel 38 while the closure tab 26 is in the closed configuration illustrated in FIGS. 1 and 2. Nonetheless, and in accordance with the exemplary embodiment of the present invention, the restricting tab 34 is resilient enough so that it is capable of readily, and automatically, entering the arresting opening 48 and engaging the arresting edge 52 during subsequent occurrences of the arresting opening 48 reaching the restricting tab. In accordance with an alternative embodiment of the present invention, the restricting tab 34 is more rigid than described immediately above, such that a user must lift the arresting opening 48 above the restricting tab 34 as part of the process of changing out of the opened, releasably locked configuration illustrated in FIG. 3.

While the closure tab 26 is in the opened, releasably locked configuration illustrated in FIG. 3, the closure tab can be pulled and thereby placed in the opened, uninserted configuration illustrated in FIG. 4. However, and in accordance with the exemplary embodiment of the present invention, advantageously more force can be required to remove the restricting tab 34 from the arresting opening 48 to change to the opened, uninserted configuration illustrated in FIG. 4 than is required to initiate the change to the closed configuration illustrated in FIGS. 1 and 2. In accordance with the exemplary embodiment, this difference in the required force is attributable to the arresting edge 52 being curved in a manner that seeks to cause the at least somewhat resilient restricting tab 34 to be temporarily distorted into a curved shape (which confirms to the shape of the arresting edge 52) when transitioning from the opened, releasably locked configuration illustrated in FIG. 3 to the uninserted configuration illustrated in FIG. 4.

Whereas the arresting opening 48 is in the shape of a circular segment for the exemplary embodiment, the arresting opening 48 is in other shapes in alternative embodiments of the present invention. For example, the arresting opening 48 can alternatively be in the shape of a narrow slot or a right parallelogram, or the like.

FIG. 5 illustrates an example of a blank 54 from which the carton 10 can be acceptably formed, and the blank 54 will be described in the following, in accordance with the exemplary embodiment of the present invention. The blank 54 includes an inner attachment panel 56 that is positioned within the carton 10 after it is erected. The attachment panel 56 is connected along a longitudinal fold line 58 to the inner front panel 18. The inner front panel 18 is connected along a longitudinal fold line 60 to the right side panel 20. The right side panel 20 is connected along a lower lateral fold line 62 to a lower flap 64. The right side panel 20 is connected along an upper lateral fold line 66 to the inner upper panel 32. The inner upper panel 32 includes the inner opening 42.

The rear panel 24 is connected along a longitudinal fold line 68 to the right side panel 20. Lower and upper flaps 70, 72 are respectively attached to the rear panel 24 along lower and upper lateral fold lines 74, 76. The left side panel 22 is connected to the rear panel 24 along a longitudinal fold line 78. A lower flap 80 is connected along a lower lateral fold line 82 to the left side panel 22. The outer upper panel 38 is connected along an upper lateral fold line 84 to the upper edge of the left side panel 22. An outer attachment panel 85 is connected by a lateral fold line 87 to the outer upper panel 38.

Regarding the security tab 36 in the outer upper panel 38, a tear line 86 extends around and thereby defines the security tab 36. After the carton 10 is erected from the blank 54, an end user removes the security tab 36 by tearing along the tear line 86. As indicated above, removal of the security tab 36 exposes the outer opening 40 (FIGS. 3 and 4). In accordance with the exemplary embodiment of the present invention, the inner and outer openings 40, 42 are at least about the same size and shape. In addition, the inner and outer openings 40, 42 are aligned in the erected carton 10, so that they can be in communication with one another. The security tab 36 is optional, and if it is not included, the tear line 86 can be a continuous cut line that defines the outer opening 40. The outer upper panel 38 also includes the cut edge 46/access opening 47, which can also be optional.

The outer front panel 16 is connected to the left side panel 22 along a longitudinal fold line 90. The longitudinal fold line 90 extends from the bottom edge of the outer front panel 16 to the intermediate lateral fold line 28. The closure tab 26 is connected to the outer front panel 16 at the intermediate lateral fold line 28. In addition, the closure tab 26 is releasably connected to the upper portion of the left side panel 22, and an end of the outer upper panel 38 along a tear line 92 that is interrupted by the access opening 47 in the outer upper panel 38. The tear line 92 extends upwardly from the inner end of the lateral fold line 28. Alternatively, all of the tear line 92 can be in the form of a cut line rather than a tear line. The upper lateral fold line 30 extends across the closure tab 26. A lower flap 94 is connected to the outer front panel 16 at a lower lateral fold line 96.

An acceptable method for erecting the carton 10 from the blank 54 will be described in the following, in accordance with the exemplary embodiment of the present invention. Folding is performed along the longitudinal fold lines 58, 60, 68, 78, 90 so that the inner attachment panel 56 is positioned within the cartons' interior and the outer front panel 16 overlaps the lower portion of the inner front panel 18. More specifically in this configuration, the inner attachment panel 56 is securely fastened to a marginal portion of the inside-facing surface of the left side panel 22, and the outer front panel 16 is securely fastened to the inner front panel 18.

In accordance with the exemplary embodiment of the present invention, the bottom end 14 of the carton 10 is defined by the lower flaps 70, 94, 64, 80 which are located at the lower margin of the blank 54. Assembly of the bottom end 14 of the carton 10 can begin with folding the lower flaps 70, 94 inwardly. Thereafter, the lower flaps 64, 80 are folded inwardly so that they overlap the lower flaps 70, 94, and there is also overlapping between the lower flaps 64, 80. One or more of the lower flaps 70, 94, 64, 80 are fastened to each other to securely close the bottom end 14 of the carton.

In accordance with the exemplary embodiment of the present invention, the top end 12 of the carton 10 is defined at least by the upper flap 72, inner upper panel 32, and outer upper panel 38 which are located at the upper margin of the blank 54. Assembly of the top end 12 of the carton 10 can begin with folding the upper flap 72 inwardly, and then folding the inner upper panel 32 inwardly. Thereafter, and after tearing all along the tear line 92, the closure tab 26 is folded along the upper lateral fold line 30 so that the respective portion of the closure tab 26 (i.e., the portion which includes the arresting opening 48) overlies a portion of the inner upper panel 32 and covers the inner opening 42. Finally, the outer upper panel 38 is folded over the portion of the closure tab 26 that includes the arresting opening 48, and the outer attachment panel 85 is folded so that it overlaps the upper marginal portion of the outer side of the right side panel 20. The outer attachment panel 85 is securely fastened to the upper marginal portion of the outer side of the right side panel 20.

The above-discussed fastening carried out during the erection of the carton 10 from the blank 54 can be via adhering, such as with an adhesive substance such as glue or rubber cement, or any other adhesive substance that is suitable. Alternatively or in addition, the fastening can be via any other conventional means.

In accordance with the exemplary embodiment of the present invention, a fold line can be any at least somewhat line-like arranged, although not necessarily straight, form of weakening that facilitates folding therealong; and a tear line can be any at least somewhat line-like arranged, although not necessarily straight, form of weakening that facilitates tearing therealong. More specifically, but not for the purpose of narrowing the scope of the present invention, conventional fold lines include: a crease, such as formed by folding; a score line, such as formed with a blunt scoring knife, or the like, which creates a crushed portion in the material along the desired line of weakness; a cut that extends partially into the material along the desired line of weakness, and/or a series of spaced apart cuts that extend partially into and/or completely through the material along the desired line of weakness; or various combinations of these features. More specifically, but not for the purpose of narrowing the scope of the present invention, conventional tear lines include: a cut that extends partially into the material along the desired line of weakness, and/or a series of spaced apart cuts that extend partially into and/or completely through the material along the desired line of weakness, or various combinations of these features.

As a more specific example, one type of conventional tear line is in the form of a series of spaced apart cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line.

In situations where cutting is used to provide a fold line, typically the cutting will not be overly extensive in a manner that might cause a reasonable user to incorrectly consider the fold line to be a tear line. In contrast, where nicks are present in a cut line (e.g., tear line), typically the nicks will not be overly large or overly numerous in a manner that might cause a reasonable user to incorrectly consider the subject line to be a fold line.

In accordance with one specific version of the exemplary embodiment of the present invention, all of the fold lines in the blank 54 are score lines, except that each of the score lines of the fold lines 58, 60, 66 further includes a series of spaced apart cuts that extend along the score line. Acceptable dimensions for this specific version of the blank 54 of the exemplary embodiment of the present invention are described in the following, with reference to FIG. 5. The dimension D1 is about 7.5 inches. The dimension D2 is about 1.0 inch. The dimension D3 is about 0.25 inches. The dimension D4 is about 7.469 inches. The dimension D5 is about 0.906 inches. The laterally extending upper edge of the restricting tab 34 is about 0.125 inches above the upper, laterally extending edges 98 of the inner front panel 18. Each of the dimensions D6 is about 1.0 inch. The dimensions D7 (lateral width of the inner front panel 18), D8 (lateral width of the rear panel 24) and D9 (lateral width of the outer front panel 16/slidable closure tab 26) respectively are about 2.313, 2.375 and 2.344 inches. Other dimensions are also within the scope of the present invention.

In accordance with the exemplary embodiment of the present invention, the blank 54 is constructed of paperboard, or the like, and the paperboard can optionally have one or more other materials coated or laminated thereon. For example, paperboard typically weighs at least about 100 pounds per ream, with each sheet of paperboard typically being at least about 0.012 inches thick, so that it is heavier and more rigid than ordinary paper. The blank 54 can also be constructed of other materials, such as cardboard or any other material having properties suitable for enabling the carton 10 to function at least generally as described above.

For example, one or both sides of the blank 54 can be coated with a clay coating, or the like. The clay coating can be printed over with product, advertising, and other information or images. The blank 54 may then be coated with a varnish or other protective coating to protect any information printed on the blank. The blank 54 may also be coated with, for example, a moisture barrier layer, on either or both sides of the blank 54. Other coating and laminating upon the blank 54 is also within the scope of the present invention.

The directional references, for example "top", "front", "left side" and "longitudinal", referred to in this Detailed Description section are used for ease of understanding rather than for the purpose of narrowing the scope of the present invention. For example and alternatively, the front can be referred to as the rear or a side, and the other directional references can also be modified and/or exchanged.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A reclosable carton, comprising:

first and second ends that are spaced apart from one another in a longitudinal direction, wherein the first end includes first and second panels that are in an overlapping relationship with respect to one another, and the first panel includes at least one opening for being in communication with the carton's interior;

at least one sidewall extending between the first and second ends and extending at least partially around the carton's interior;

a flexible, elongate closure tab that is connected to the sidewall and extends through a slot so that a portion of the closure tab is interposed between the first and second panels, wherein (a) the portion of the closure tab can be slid, while the portion of the closure tab is interposed between the first and second panels, between (1) a closed configuration in which the portion of the closure tab at least substantially obstructs the opening in the first panel, and (2) an open configuration in which at least some of the opening in the first panel is not substantially obstructed by the closure tab, and (b) the closure tab includes an edge that at least partially defines an opening in the closure tab; and a projection that projects from the sidewall, wherein the projection and the closure tab are cooperative so that the projection extends into the opening in the closure tab and engages said edge of the closure tab to at least discourage the portion of the closure tab from being completely pulled out of the slot during the open configuration.

2. The carton according to claim 1, wherein the second panel includes an opening that is aligned with the opening in the first panel, and the opening in the first panel is open to the opening in the second panel during the open configuration.

3. The carton according to claim 1, wherein said edge of the closure tab is an arcuate edge of the closure tab.

4. The carton according to claim 3, wherein the closure tab includes a substantially straight edge that at least partially defines the opening in the closure tab.

5. The carton according to claim 4, wherein the substantially straight edge includes opposite ends that are respectively adjacent opposite ends of the arcuate edge.

6. The carton according to claim 4, wherein:

the closure tab is foldably connected to the sidewall by a fold line, and the substantially straight edge is positioned between the arcuate edge and the fold line.

7. The carton according to claim 1, wherein the projection comprises a restricting tab.

8. The carton according to claim 7, wherein:

the sidewall includes third and fourth panels that are in an overlapping relationship with respect to one another;

the closure tab is connected to the third panel; and the restricting tab is connected to the fourth panel.

9. The carton according to claim 8, wherein the fourth panel is positioned between the third panel and the carton's interior.

10. The carton according to claim 9, wherein:

the carton includes a front and a rear that are spaced apart from one another in a lateral direction;

the third and fourth panels are at least proximate the front of the carton; and a minimum distance between the opening in the first panel and the front of the carton is less than about 19% of a minimum distance between the front and the rear of the carton.

11. The carton according to claim 9, wherein:

the first panel is positioned above the second panel;

the opening in the first panel is a first opening;

the first panel further includes a second opening that is open at a forward end of the first panel for providing access to at least some of the closure tab during the closed configuration;

the second opening is positioned between the first opening and the front of the carton; and a minimum distance between the first opening and the second opening is less than about 9% of a minimum distance between the front and the rear of the carton.

12. The carton according to claim 1, wherein:

the carton includes a front and a rear that are spaced apart from one another in a lateral direction;

the closure tab and the projection are connected to the sidewall at least proximate the front of the carton; and a minimum distance between the opening in the first panel and the front of the carton is less than about 19% of a minimum distance between the front and the rear of the carton.

13. The carton according to claim 12, wherein:

the first panel is positioned above the second panel;

the opening in the first panel is a first opening;

the first panel further includes a second opening that is open at a forward end of the first panel for providing access to at least some of the closure tab during the closed configuration;

the second opening is positioned between the first opening and the front of the carton; and a minimum distance between the first opening and the second opening is less than about 9% of the minimum distance between the front and the rear of the carton.

14. The carton according to claim 12, wherein the minimum distance between the opening in the first panel and the front of the carton is less than about 17% of the minimum distance between the front and the rear of the carton.

15. The carton according to claim 12, wherein the minimum distance between the opening in the first panel and the front of the carton is less than about 15% of the minimum distance between the front and the rear of the carton.

16. The carton according to claim 12, wherein the minimum distance between the opening in the first panel and the front of the carton is less than, or equal to, about 13.3% of the minimum distance between the front and the rear of the carton.

17. The carton according to claim 1, wherein:

the carton includes a front and a rear that are spaced apart from one another in a lateral direction;

the first panel is positioned above the second panel;

the opening in the first panel is a first opening;

the first panel further includes a second opening that is open at a forward end of the first panel for providing access to at least some of the closure tab during the closed configuration; and a minimum distance between the first opening and the second opening is less than about 9% of a minimum distance between the front and the rear of the carton.

18. The carton according to claim 17, wherein the minimum distance between the first opening and the second opening is less than about 7% of the minimum distance between the front and the rear of the carton.

19. The carton according to claim 17, wherein the minimum distance between the first opening and the second opening is less than about 5% of the minimum distance between the front and the rear of the carton.

20. The carton according to claim 17, wherein the minimum distance between the first opening and the second opening is less than, or equal to, about 3.3% of the minimum distance between the front and the rear of the carton.

21. The carton according to claim 1, wherein the projection and the closure tab are configured so that, during the closed configuration, the projection:

does not extend into the opening in the closure tab, and does not engage said edge of the closure tab.

22. The carton according to claim 1, wherein:

the closure tab includes (a) a first pair of opposite edges, and (b) a second pair of opposite edges; and the opening in the closure tab is (a) positioned between the first pair of opposite edges, (b) positioned between the second pair of opposite edges, and (c) distant from all edges of the first and second pairs of opposite edges.

23. A reclosable carton, comprising:

first and second ends that are spaced apart from one another in a longitudinal direction, wherein the first end includes first and second panels that are in an overlapping relationship with respect to one another, and the first panel includes at least one opening for being in communication with the carton's interior;

at least one sidewall extending between the first and second ends and extending at least partially around the carton's interior, with the sidewall defining a front and a rear of the carton that are spaced apart from one another in a lateral direction;

a flexible, elongate closure tab that is connected to the sidewall proximate the front of the carton, wherein the closure tab defines an opening that extends through the closure tab, and wherein the closure tab extends through a slot so that a portion of the closure tab is interposed between the first and second panels, and the portion of the closure tab can be slid, while the portion of the closure tab is interposed between the first and second panels, between a closed configuration in which the portion of the closure tab at least substantially obstructs the opening in the first panel, and an open configuration in which at least some of the opening in the first panel is not substantially obstructed by the closure tab; and a projection that projects from the side wall proximate the front of the carton, wherein the projection extends into the opening in the closure tab for at least discouraging the portion of the closure tab from being completely pulled out of the slot during the open configuration, and the projection does not extend into the opening in the closure tab during the closed configuration.

24. The carton according to claim 23, wherein:

the closure tab includes (a) a first pair of opposite edges, and (b) a second pair of opposite edges; and the opening in the closure tab is (a) positioned between the first pair of opposite edges, (b) positioned between the second pair of opposite edges, and (c) distant from all edges of the first and second pairs of opposite edges.

25. The carton according to claim 23, wherein:

the closure tab includes a plurality of edges that define the opening in the closure tab;

the plurality of edges, which define the opening in the closure tab, includes (a) an arcuate edge, and (b) a substantially straight edge;

the closure tab is foldably connected to the sidewall by a fold line; and the substantially straight edge is positioned between the arcuate edge and the fold line.

26. The carton according to claim 23, wherein a minimum distance between the opening in the first panel and the front of the carton is less than about 19% of a minimum distance between the front and the rear of the carton.

27. A blank for forming a carton, the blank comprising:

an inner front panel including a projecting restricting tab;

a right side panel foldably connected to the inner front panel;

a first upper panel foldably connected to the right side panel and including an opening;

a rear panel foldably connected to the right side panel;

a left side panel foldable connected to the rear panel;

a second upper panel foldably connected to the left side panel;

an outer front panel foldably connected to the left side panel; and a closure tab connected to the outer front panel, wherein the closure tab is for sliding between the first and second upper panels for opening and closing the opening after the carton is erected from the blank, and the closure tab includes an edge that is operative for being engaged by the restricting tab and thereby at least discouraging the closure tab from being completely pulled out from between the first and second upper panels after the carton is erected from the blank, and wherein said edge of the closure tab at least partially defines an opening in the closure tab.

28. The blank according to claim 27, wherein:

the first upper panel includes first, second, third and fourth edges;

the first and second edges are spaced apart from one another in a longitudinal direction;

the third and fourth edges are spaced apart from one another in a lateral direction;

the opening in the first upper panel is closer to the first edge than to the second edge;

a minimum distance between the opening in the first upper panel and the first edge is less than about 19% of a minimum distance between the first edge and the second edge; and the minimum distance between the first edge and the second edge is greater than a minimum distance between the third edge and the fourth edge.

29. A carton erected from the blank of claim 27, wherein:

the outer front panel overlaps at least a lower portion of the inner front panel;

the first and second upper panels are superposed with one another, and the closure tab extends through a slot so that a portion of the closure tab is interposed between the first and second upper panels;

the portion of the closure tab can be slid, while the portion of the closure tab is interposed between the first and second upper panels, between (1) a closed configuration in which the portion of the closure tab at least substantially obstructs the opening in the first upper panel, and (2) an open configuration in which at least some of the opening in the first upper panel is not substantially obstructed by the closure tab; and said edge of the closure tab is engaged by the restricting tab so that the closure tab is at least discouraged from being completely pulled out from between the first and second upper panels during the open configuration.

30. The blank according to claim 27, further including a plurality of flaps respectively located at the blank's margins.

31. The blank according to claim 27, wherein:

the closure tab includes (a) a first pair of opposite edges, and (b) a second pair of opposite edges; and the opening in the closure tab is (a) positioned between the first pair of opposite edges, (b) positioned between the second pair of opposite edges, and (c) distant from all edges of the first and second pairs of opposite edges.

32. The blank according to claim 27, wherein:

said edge of the closure tab is an arcuate edge of the closure tab;

the closure tab includes a substantially straight edge that at least partially defines the opening in the closure tab;

the closure tab is foldably connected to the outer front panel by a fold line; and the substantially straight edge is positioned between the arcuate edge and the fold line.

* * * * *